US005381739A

United States Patent [19]

Kilpatrick et al.

[11] Patent Number: 5,381,739

[45] Date of Patent: Jan. 17, 1995

[54] PAPERBOARD PALLET WITH DECKING MEMBERS ADJACENT TO INNER PANELS OF STRINGERS

[75] Inventors: Ted D. Kilpatrick, Ponte Vedra Beach, Fla.; Arthur M. Wagner, Geneva, Ill.

[73] Assignee: Gate Pallet Systems, Inc., Crown Point, Ind.

[21] Appl. No.: 213,233

[22] Filed: Mar. 15, 1994

Related U.S. Application Data

[63] Continuation-in-part of Ser. No. 179,111, Jan. 10, 1994, which is a continuation-in-part of Ser. No. 38,001, Mar. 29, 1993, Pat. No. 5,365,857.

[51] Int. Cl.[6] ..... B65D 19/00

[52] U.S. Cl. ..... 108/51.3

[58] Field of Search ..... 108/51.1, 51.3, 56.1, 108/56.3, 57.1

[56] References Cited

U.S. PATENT DOCUMENTS

| | | | |
|---|---|---|---|
| 3,131,656 | 5/1964 | Houle | 108/56 |
| 3,165,078 | 1/1965 | White | 108/56 |
| 3,659,534 | 5/1972 | Childs | 108/56 |
| 3,683,822 | 8/1972 | Roberts et al. | 108/56 |
| 4,792,325 | 12/1988 | Schmidtke | 493/334 |
| 4,802,421 | 2/1989 | Atterby et al. | 108/51.1 |
| 4,831,938 | 5/1989 | Atterby et al. | 108/51.3 |
| 4,867,074 | 9/1989 | Quasnick | 108/51.3 |
| 5,001,991 | 3/1991 | Smith | 108/51.3 |

*Primary Examiner*—Kenneth J. Dorner
*Assistant Examiner*—Gerald A. Anderson
*Attorney, Agent, or Firm*—Dressler, Goldsmith, Shore & Milnamow, Ltd.

[57] ABSTRACT

A pallet comprises a plurality of stringers extending longitudinally and a plurality of decking members extending transversely. As folded from corrugated paperboard, each stringer has an upper panel and six panels on each side of a generally vertical plane intersecting the upper panel. The panels on each side include an outer panel extending downwardly and outwardly from the upper panel, an outer panel extending inwardly from the downwardly and outwardly extending outer panel, an inner panel extending upwardly from the inwardly extending outer panel and secured to the like panel on the other side, an inner panel extending outwardly from the upwardly extending inner panel and secured adhesively to the upper panel, an inner panel extending downwardly and inwardly from the outwardly extending inner panel, and an inner panel extending outwardly from the downwardly and inwardly extending inner panel and secured adhesively to the inwardly extending outer panel. As folded from corrugated paperboard, each decking member has a generally planar upper edge and extends through aligned apertures in the downwardly and outwardly extending outer panels, the downwardly and inwardly extending inner panels, and the upwardly extending inner panels. The upper edges of the decking members are secured adhesively to the outwardly extending inner panels. Two longitudinally spaced sets of aligned slots in the downwardly and outwardly extending outer panels, in the downwardly and inwardly extending inner panels, and in the upwardly extending inner panels accommodate a lift fork.

8 Claims, 1 Drawing Sheet

PAPERBOARD PALLET WITH DECKING MEMBERS ADJACENT TO INNER PANELS OF STRINGERS

This application is a continuation-in-part of U.S. Pat. application Ser. No. 08/179,111 filed Jan. 10, 1994, and assigned commonly herewith. U.S. Pat. application Ser. No. 08/179,111 is a continuation-in-part of U.S. Pat. application Ser. No. 08/038,001 filed Mar. 29, 1993, now U.S. Pat. No. 5,365,857 and assigned commonly herewith.

TECHNICAL FIELD OF THE INVENTION

This invention pertains to a pallet made predominantly of paperboard material, such as corrugated paperboard, and employing stringers extending longitudinally and decking members extending transversely. This invention contemplates that generally planar upper edges of the decking members are adjacent to and may be adhesively secured to certain inner panels of the respective stringers.

BACKGROUND OF THE INVENTION

Usage of shipping pallets made predominantly of corrugated paperboard material is widespread, primarily because of their low cost, recyclability, and cleanliness. Typically, such pallets employ longitudinally extending, transversely spaced stringers, which are made from folded pieces of corrugated paperboard. Such pallets also may employ transversely extending, longitudinally spaced decking members, which also are made from folded pieces of corrugated paperboard.

As described above, shipping pallets made predominantly of paperboard material, such as corrugated paperboard, are exemplified in Schmidtke U.S. Pat. No. 4,792,325, Quasnick U.S. Pat. No. 4,867,074, and Smith U.S. Pat. No. 5,001,991. Similar pallets made predominantly of corrugated paperboard are available commercially from Gate Pallet Systems, Inc. of Crown Point, Indiana, under its PAYLOAD trademark.

As exemplified in the Schmidtke, Quasnick, and Smith patents noted above, such a pallet may have a plurality of stringers extending longitudinally and having generally trapezoidal profiles, which define relatively wide upper edges and relatively narrow, lower edges, along with a plurality of decking members extending transversely through aligned apertures in the respective stringers, near the upper edges of the respective stringers. The decking members also may have generally trapezoidal profiles, which define relatively wide upper edges and relatively narrow lower edges. The upper edges of the decking members may be adhesively secured to generally horizontally extending outer panels of the respective stringers.

Other pallets of related interest are disclosed in Hermitage U.S. Pat. No. 2,728,545, Houle U.S. Pat. No. 3,131,656, Gifford U.S. Pat. No. 3,464,371, Childs U.S. Pat. No. 3,659,534, Roberts U.S. Pat. No. 3,683,822, Melli U.S. Pat. No. 4,563,377, British Patent Specification No. 996,516, German Patent No. 1,250,352, and Swiss Patent No. 512,367.

As exemplified in the Schmidtke, Quasnick, and Smith patents noted above, the relatively narrow lower edges of the stringers allow such a pallet to be smoothly conveyed via a roller conveyor employing transversely extending rollers if the respective stringers extend along the conveyor, across the rollers. However, if the stringers extend across such a conveyor, the lower edges of the stringers may be sufficiently narrow to drop between rollers of the conveyor so as not to allow the pallet to be smoothly conveyed via the conveyor. In some instances, particularly if the rollers are spaced widely from one another, it may be very difficult or even impossible to convey the pallet with the stringers extending across the rollers.

This invention has resulted from efforts to improve such a pallet employing stringers extending longitudinally and decking members extending transversely.

SUMMARY OF THE INVENTION

This invention provides an improved pallet comprising stringers extending longitudinally and decking members extending transversely through aligned apertures in the respective stringers. This invention contemplates that generally planar upper edges of the decking members are adjacent to and may be adhesively secured to certain inner panels of the respective stringers.

Each stringer is folded from a single piece of paperboard material so as to have at least nine panels including a generally horizontally extending upper panel and including at least four panels on each side of a generally vertical plane intersecting the generally horizontally extending upper panel. The panels of each stringer, on each side of the generally vertical plane, include an outer panel attached at a fold in the sheet to and extending downwardly from the generally horizontally extending upper panel, an outer panel attached at a fold in the sheet to and extending generally horizontally and inwardly from the downwardly extending outer panel, an inner panel attached at a fold in the sheet to and extending upwardly from the inwardly extending outer panel, and an inner panel attached at a fold in the sheet to and extending outwardly from the upwardly extending inner panel. Preferably, the downwardly extending panel on each side extends outwardly as well as downwardly from the generally horizontally extending upper panel on such side, whereby each stringer has a generally trapezoidal profile.

This invention contemplates that each decking member has a generally planar upper edge. This invention also contemplates that the apertures accommodating each decking member include aligned apertures in the downwardly extending outer panels of the respective stringers and in the upwardly extending inner panels of the respective stringers. This invention further contemplates that the aligned apertures are located so that generally planar upper edges of the decking members extending through the aligned apertures are adjacent to the outwardly extending inner panels of the respective stringers.

The panels of each stringer, on each side of the generally vertical plane, may include an inner panel attached at a fold in the sheet to and extending downwardly and inwardly from the outwardly extending inner panel whereupon the aligned apertures further include aligned apertures in the downwardly and inwardly extending inner panels. The panels of each stringer, on each side of the generally vertical plane, also may include an inner panel attached at a fold in the sheet to and extending generally horizontally and outwardly from the downwardly and inwardly extending inner panel and adjacent to the inwardly extending outer panel.

In a preferred embodiment, in which the upwardly extending inner panels of each stringer are secured adhesively to each other and in which each of the outwardly extending inner panels of each stringer is secured adhesively to one of the generally horizontally extending upper panels of said stringer, each of the outwardly extending inner panels of each stringer may be adhesively secured to one of the inwardly extending outer panels of said stringer. Furthermore, in the preferred embodiment, the generally planar upper edges of the decking members are secured adhesively to the outwardly extending inner panels of each stringer.

Desirably, the respective stringers have two sets of aligned slots in the downwardly extending outer panels, in the downwardly and inwardly extending inner panels, and in the upwardly extending inner panels. If provided, the sets of aligned slots are spaced longitudinally from each other along the respective stringers, so as to accommodate a lift fork.

These and other objects, features, and advantages of this invention are evident from the following description of a preferred embodiment of this invention with reference to the accompanying drawings.

DETAILED DESCRIPTION OF PREFERRED EMBODIMENT

Figure 1:
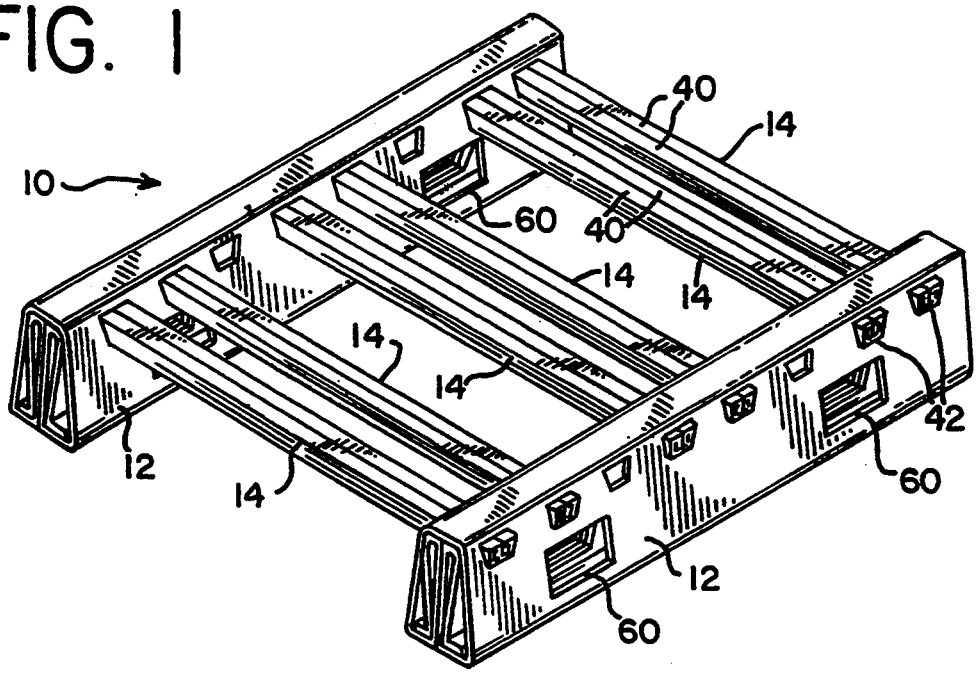
FIG. 1 is a perspective view of an improved pallet made predominantly of corrugated paperboard and constituting a preferred embodiment of this invention.

As shown in FIG. 1, a pallet 10 made predominantly of corrugated paperboard constitutes a preferred embodiment of this invention and comprises two similar stringers 12 extending longitudinally and three pairs of similar decking members 14, each decking member 14 extending transversely through a set of aligned apertures in the respective stringers 12. Although two similar stringers 12 are shown, three or four such stringers may be alternatively employed.

Each stringer 12 is folded from a single sheet of corrugated paperboard, along folding lines across the flutes of such paperboard, so as to have thirteen panels. The panels of each stringer 12 include a generally horizontally extending upper panel 20 and six panels on each side of a generally vertical plane intersecting and bisecting the upper panel 20.

The panels of each stringer 12, on each side of the generally vertical plane noted above, include an outer panel 22 attached at a fold in the sheet to and extending downwardly and outwardly from the upper panel 20, an outer panel 24 attached at a fold in the sheet to and extending generally horizontally and inwardly from the outer panel 22, an inner panel 26 attached at a fold in the sheet to and extending upwardly from the outer panel 24, and an inner panel 28 attached at a fold in the sheet to and extending generally horizontally and outwardly from the inner panel 26. The panels of each stringer 12, on each side of the aforenoted plane, further include an inner panel 30 attached at a fold in the sheet to and extending downwardly and inwardly from the inner panel 28 and an inner panel 32 attached at a fold in the sheet to and extending generally horizontally and outwardly from the inner panel 30.

Figure 2:
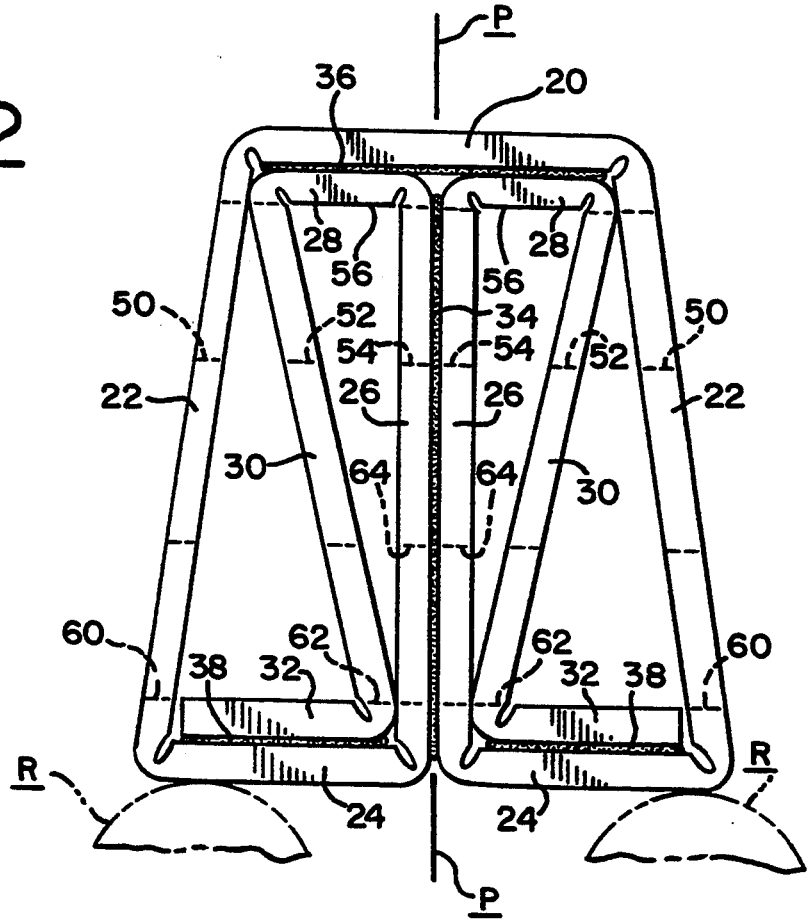
FIG. 2, on a larger scale, is an end view of one of two stringers of the improved pallet. Two rollers of a roller conveyor are shown in dashed lines.

Thus, as shown in FIG. 2, each stringer 12 has a generally trapezoidal profile with a relatively narrow upper edge defined by the upper panel 20 and with a relatively wide lower edge defined by the outer panels 24. Also, each stringer 12 is similar but inverted when compared to the pallet stringer illustrated and described in U.S. Pat. application Ser. No. 08/179,111, supra.

As shown in FIG. 2, certain panels of each stringer 12 are secured adhesively to other panels of such stringer 12, along such stringer 12. Thus, the upwardly extending inner panel 26 on each side of the generally vertical plane noted above is secured adhesively to the similar panel 26 on the other side thereof, in a wide region 34 between the respective panels 26. Also, the outwardly extending inner panel 28 on each side of the aforenoted plane is secured adhesively to the outer panel 22, in a wide region 36 between each of the panels 28 and the panel 22. Further, on each side of the same plane, the outwardly extending inner panel 32 is secured adhesively to the inwardly extending outer panel 24, in a wide region 38 between the panel 32 and the panel 24.

Each decking member 14 is similar to the decking members illustrated and described in Schmidtke U.S. Pat. No. 4,792,325, Quasnick U.S. Pat. No. 4,867,074, and Smith U.S. Pat. No. 5,001,991, the disclosures of which are incorporated herein by reference. Each decking member 14 is folded from a single sheet of corrugated paperboard, along folding lines across the flutes of such paperboard, so as to have multiple panels including two generally horizontally extending upper panels 40 and a generally horizontally extending lower panel 42. Each decking member 14 is folded so as to have a generally trapezoidal profile with a relatively wide upper edge defined by the upper panels 40 of such decking member 14 and a relatively narrow lower edge defined by the lower panel 42 thereof.

In each stringer 12, the aligned apertures of each set are configured to accommodate a decking member 14 and include an aperture 50 in each of the downwardly and outwardly extending outer panels 22 of each stringer 12, an aperture 52 in each of the downwardly and inwardly extending panels 30 of each stringer 12, and an aperture 54 in each of the upwardly extending inner panels 26 of each stringer 12. In each stringer 12, each of the apertures 50, 52, 54 has an upper edge located so as to be generally coplanar with an inner, lower surface 56 of each of the generally horizontally and outwardly extending inner panels 28 of such stringer 12.

When the stringers 12 and the decking members 14 are assembled so that each decking member 14 extends transversely through a set of the aligned apertures 50, 52, 54 of the respective stringers 12, the relatively wide upper edge of such decking member 14, as defined by the upper panels 40 of such decking member 14, is adjacent to the inner, lower surfaces 56 of the outwardly extending inner panels 28 of the respective stringers 12. Each decking member 14 is secured adhesively to the respective stringers 12 not only at the margins of the respective apertures 50, 52, 54 accommodating such decking member 14 but also between the upper panels 40 defining the upper edge of such decking member 14 and the outwardly extending inner panels 28 of the respective stringers 12.

A lift fork (not shown) can enter the pallet 10 longitudinally, between the respective stringers 12. As shown in FIG. 2, each stringer 12 has two sets of aligned slots to accommodate such a fork. The sets of aligned slots are spaced longitudinally from each other along the respective stringers 12. The aligned slots of each set include a slot 60 in each of the downwardly and outwardly extending outer panels 22 of each stringer 12, a slot 62 in each of the downwardly and inwardly extending inner panels 30 of each stringer 12, and a slot 64 in each of the upwardly extending inner panels 26 of each stringer 12.

In each stringer 12, each of the aligned slots 60, 62, 64 has a lower edge, which is located so as to be generally coplanar with an inner, upper surface 66 of each of the generally horizontally extending inner panels 32 of such stringer 12. Thus, when a lift fork enters the pallet 10 transversely, the same surfaces 66 are disposed to guide the lower edges of the lift fork through the aligned apertures 60, 62, 64. Thus, the pallet 10 offers a significant advantage over previously known pallets employing stringers having downwardly opening notches to accommodate a lift fork.

As shown in FIG. 2, the relatively wide lower edge defined by the generally horizontally extending outer panels 24 of each stringer 12 can bridge the rollers R of a roller conveyor, even if the rollers R are spaced widely from one another, so as to permit the pallet 10 to be smoothly conveyed with the stringers 12 extending along the rollers R. Thus, the pallet 10 offers a significant advantage over previously known pallets employing stringers having narrower lower edges.

Each stringer 12 has a downwardly flaring, generally trapezoidal profile compared to the upwardly flaring, generally trapezoidal profiles of prior stringers in prior pallets with decking members, as exemplified in the Schmidtke, Quasnick, and Smith patents noted above. The lateral stability of each stringer 12 in the pallet 10 is improved. Each stringer 12 in the pallet 10 has a wider footprint that facilitates double-stacking, which refers to stacking of the pallet 10 onto a load carried by a similar or dissimilar pallet.

Where adhesive securement is employed in the pallet 10, a so-called "cold melt" or "cold set" adhesive is suitable, such as Code No. 3715 or Code No. 3715B, both of which are available commercially from H. B. Fuller Co. of Palatine, Ill.

Various modifications may be made in the preferred embodiment described above without departing from the scope and spirit of this invention.

We claim:

1. A pallet comprising stringers extending longitudinally and decking members extending transversely through aligned apertures in the respective stringers, each stringer being folded from a single piece of paperboard material so as to have at least nine panels including a generally horizontally extending upper panel and including at least four panels on each side of a generally vertical plane intersecting the generally horizontally extending upper panel, which extends to each side of the generally vertical plane, wherein the panels of each stringer, on each side of the generally vertical plane, include (a) an outer panel attached at a fold in the sheet to and extending downwardly from the generally horizontally extending upper panel, (b) an outer panel attached at a fold in the sheet to and extending generally horizontally and inwardly from the downwardly extending outer panel, (c) an inner panel attached at a fold in the sheet to and extending upwardly from the inwardly extending outer panel, approximately to the upper panel, and (d) an inner panel attached at a fold in the sheet to and extending generally horizontally and outwardly from the upwardly extending inner panel and being adjacent to and secured adhesively to the upper panel, wherein each decking member has a generally planar upper edge, wherein the aligned apertures include aligned apertures in the downwardly extending outer panels of the respective stringers and in the upwardly extending inner panels of the respective stringers, and wherein the aligned apertures are located so that the generally planar upper edges of the decking members extending through the aligned apertures are adjacent to the outwardly extending inner panels of the respective stringers.

2. The pallet of claim 1 wherein the upwardly extending inner panels of each stringer are secured adhesively to each other, wherein the outwardly extending inner panels of each stringer are secured adhesively to the upper panel of said stringer, and wherein the generally planar upper edges of the decking members are secured adhesively to the outwardly extending inner panels of each stringer.

3. The pallet of claim 2 wherein the decking members also are secured adhesively to the respective stringers at margins of the aligned apertures.

4. The pallet of claim 1 wherein the panels of each stringer, on each side of the generally vertical plane, further include an inner panel attached at a fold in the sheet to and extending downwardly and inwardly from the outwardly extending inner panel and wherein the aligned apertures further include aligned apertures in the downwardly and inwardly extending inner panels.

5. The pallet of claim 4 wherein the panels of each stringer, on each side of the generally vertical plane, further include an inner panel attached at a fold in the sheet to and extending generally horizontally and outwardly from the downwardly and inwardly extending inner panel and adjacent to the inwardly extending outer panel.

6. The pallet of claim 5 wherein the respective stringers have two sets of aligned slots in the downwardly extending outer panels, in the downwardly and inwardly extending inner panels, and in the upwardly extending inner panels, the sets being spaced longitudinally from each other.

7. The pallet of claim 5 wherein the downwardly extending outer panels of each stringer extend downwardly and outwardly from the generally horizontally extending upper panel of said stringer, such that each stringer has a generally trapezoidal profile.

8. The pallet of claim 7 wherein the respective stringers have two sets of aligned slots in the downwardly extending outer panels, in the downwardly and inwardly extending inner panels, and in the upwardly extending inner panels, the sets being spaced longitudinally from each other.

* * * * *